US009343820B2

(12) United States Patent
DeSantis et al.

(10) Patent No.: US 9,343,820 B2
(45) Date of Patent: May 17, 2016

(54) CRIMP CONTACT AND CABLE ASSEMBLY INCLUDING THE SAME

(71) Applicant: Tyco Electronics Corporation, Berwyn, PA (US)

(72) Inventors: Peter DeSantis, Harrisburg, PA (US); Jeffrey Richard Ruth, Middletown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 73 days.

(21) Appl. No.: 13/739,233

(22) Filed: Jan. 11, 2013

(65) Prior Publication Data

US 2014/0199897 A1 Jul. 17, 2014

(51) Int. Cl.

| | |
|---|---|
| ***H01R 4/18*** | (2006.01) |
| ***H01R 43/048*** | (2006.01) |
| *H01R 13/11* | (2006.01) |
| *H01R 13/03* | (2006.01) |
| *H01R 43/058* | (2006.01) |

(52) U.S. Cl.
CPC ..... *H01R 4/18* (2013.01); *H01R 4/183* (2013.01); *H01R 43/058* (2013.01)

(58) Field of Classification Search
CPC ..... H01R 4/185; H01R 43/048; H01R 4/22; H01R 43/055; H01R 13/5808; H01R 13/11; H01R 13/03; H01R 43/16; H01R 4/2495; H01R 4/18; H01R 4/183
USPC ..... 439/878, 96, 790, 877, 882, 888, 948
See application file for complete search history.

(56) References Cited

U.S. PATENT DOCUMENTS

| | | | | |
|---|---|---|---|---|
| 2,600,012 A * | 6/1952 | Macy | H01R 4/2495 24/115 A |
| 2,799,841 A * | 7/1957 | Macy | H01R 4/2495 439/423 |
| 3,964,815 A * | 6/1976 | McDonough | 439/423 |
| 5,423,474 A * | 6/1995 | Kanagawa et al. | 228/110.1 |
| 5,607,328 A * | 3/1997 | Joly | 439/852 |

(Continued)

FOREIGN PATENT DOCUMENTS

| | | |
|---|---|---|
| GB | 844727 A | 8/1960 |
| GB | 2275879 A | 9/1994 |

OTHER PUBLICATIONS

European Search Report, European Application No. EP14150486.0/ Patent No. 1801, International Filing Date Mar. 4, 2014.

*Primary Examiner* — Amy Cohen Johnson
*Assistant Examiner* — Matthew T Dzierzynski

(57) ABSTRACT

Cable assembly including an electrical wire and a crimp contact engaged to a terminal end of the electrical wire. The crimp contact has a centerline and first and second sidewalls that extend from the centerline in opposite directions. The centerline extends parallel to a longitudinal axis of the crimp contact. Each of the first and second sidewalls has a base section and a leg section. The leg section extends a lateral distance from the centerline to a longitudinal edge of the leg section. The base section extends a lateral distance from the centerline to a longitudinal edge of the base section. The lateral distance of the leg section is greater than the lateral distance of the base section for each of the first and second sidewalls. The leg sections of the first and second sidewalls are located opposite the base sections of the second and first sidewalls, respectively.

19 Claims, 5 Drawing Sheets

(56) References Cited

U.S. PATENT DOCUMENTS

| | | | | |
|---|---|---|---|---|
| 6,626,711 | B2 * | 9/2003 | Kitagawa | H01R 4/184 439/877 |
| 6,676,458 | B2 * | 1/2004 | Kuwayama et al. | 439/877 |
| 7,077,712 | B2 * | 7/2006 | Sakaguchi | H01R 4/185 439/877 |
| 7,803,008 | B2 * | 9/2010 | Onuma | H01R 4/185 439/442 |
| 7,828,612 | B2 * | 11/2010 | Kumakura | H01R 4/185 439/877 |
| 8,147,281 | B2 * | 4/2012 | Kuwayama | H01R 4/206 439/877 |
| 8,177,590 | B2 * | 5/2012 | Tanaka | H01R 4/185 439/877 |
| 8,251,759 | B2 * | 8/2012 | Matsunaga | H01R 4/185 439/877 |
| 8,328,589 | B2 * | 12/2012 | Hasebe | H01R 4/184 439/877 |
| 2006/0057904 | A1 * | 3/2006 | Sakaguchi et al. | 439/877 |
| 2010/0081325 | A1 * | 4/2010 | Matsunaga | 439/585 |
| 2010/0120302 | A1 * | 5/2010 | Kumakura | 439/878 |
| 2013/0273787 | A1 * | 10/2013 | Mitose et al. | 439/878 |

* cited by examiner

CRIMP CONTACT AND CABLE ASSEMBLY INCLUDING THE SAME

BACKGROUND OF THE INVENTION

The subject matter described and/or illustrated herein relates generally to crimp contacts that are deformed to grip one or more exposed wire conductors of an electrical wire.

A crimp contact is a type of electrical contact that is deformed (i.e., crimped) to grip wire conductors that are exposed at a terminating end of an electrical wire. The wire conductors are inserted into a cavity defined by the crimp contact, and the crimp contact is then deformed (e.g., crushed) so that the interior surfaces of the crimp contact compress and securely engage the wire conductors. Crimp contacts may facilitate connecting the electrical wire to other electrical connectors or devices. Crimp contacts may also be used to join terminating ends from two electrical wires in which the wire conductors from each terminating end are inserted into the cavity of the crimp contact prior to deforming.

Known crimp contacts are sized according to a total cross-sectional area of the wire conductors that the crimp contacts will engage. However, these known crimp contacts are typically only suitable for a limited number of cross-sectional areas. For instance, one contact configuration may only be suitable for the wire conductors of electrical wires that have wire gauges 18-20 American Wire Gauge (AWG). AWG is a frequently used standard in the industry. The tools used to deform the crimp contacts are typically configured for one type of crimp contact. As such, a manufacturer or individual working with electrical wires of different wire gauges may require a number of different crimp contacts and a number of different crimping tools.

Accordingly, there is a need for crimp contacts that are capable of gripping a greater range of wire gauges than known crimp contacts.

BRIEF DESCRIPTION OF THE INVENTION

In one embodiment, a cable assembly is provided that includes an electrical wire having a terminal end that includes at least one exposed wire conductor. The cable assembly also includes a crimp contact having a centerline and first and second sidewalls that extend from the centerline in opposite directions. The centerline extends parallel to a longitudinal axis of the crimp contact. Each of the first and second sidewalls has a base section and a leg section. The leg section extends a lateral distance from the centerline to a longitudinal edge of the leg section. The base section extends a lateral distance from the centerline to a longitudinal edge of the base section. The lateral distance of the leg section is greater than the lateral distance of the base section for each of the first and second sidewalls. The leg section of the first sidewall is located opposite the base section of the second sidewall. The leg section of the second sidewall is located opposite the base section of the first sidewall. The first and second sidewalls surround and engage the at least one wire conductor.

In another embodiment, a crimp contact is provided that includes a contact body having a centerline and first and second sidewalls that extend from the centerline in opposite directions away. The centerline extends parallel to a longitudinal axis of the crimp contact. Each of the first and second sidewalls has a base section and a leg section. The leg section extends a lateral distance from the centerline to a longitudinal edge of the leg section. The base section extends a lateral distance from the centerline to a longitudinal edge of the base section. The lateral distance of the leg section is greater than the lateral distance of the base section for each of the first and second sidewalls. The leg section of the first sidewall is located opposite the base section of the second sidewall. The leg section of the second sidewall is located opposite the base section of the first sidewall.

In some embodiments, the leg section of the first sidewall interfaces with the base section of the second sidewall and/or the leg section of the second sidewall interfaces with the base section of the first sidewall. For example, the leg section of one of the sidewalls may be folded under the base section of the opposite sidewall. As another example, the longitudinal edge of the leg section of one of the sidewalls may interface with the longitudinal edge of the base section of the opposite sidewall.

In some embodiments, the crimp contact is dimensioned to surround and engage at least one wire conductor that has a total cross-sectional area of X and, separately, to surround and engage at least one wire conductor that has a total cross-sectional area of at least about 3X.

In some embodiments, each of the leg sections of the first and second sidewalls surrounds a plurality of the wire conductors. Furthermore, in some embodiments, each of the leg sections of the first and second sidewalls may surround a different arrangement of the wire conductors. The wire conductors may also have a varying conductor density or distribution within the crimp contact as the crimp contact extends from a leading edge of the crimp contact to the electrical wire. For example, the wire conductors may laterally shift within a contact cavity of the crimp contact. In some cases, each of the leg sections of the first and second sidewalls may surround at least one common wire conductor (e.g., the same wire conductor).

DETAILED DESCRIPTION OF THE INVENTION

Figure 1:
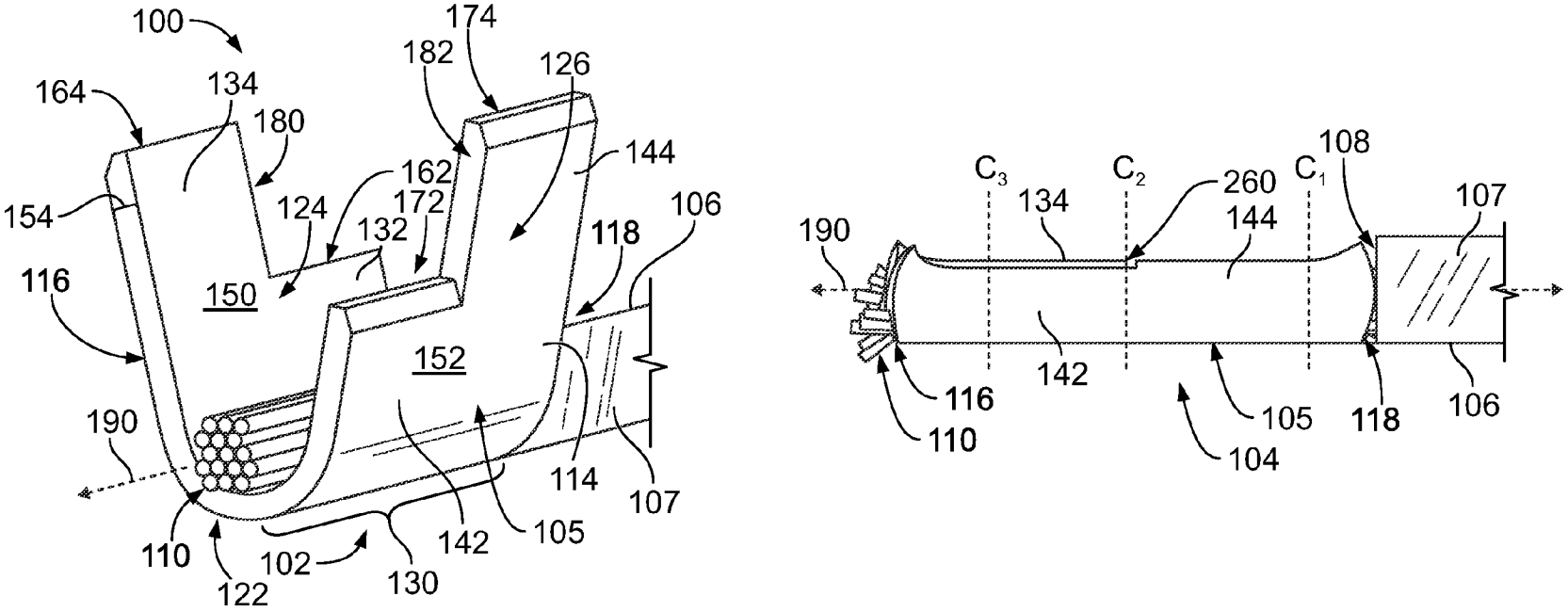
FIG. 1 is a perspective view of a portion of a cable assembly in accordance with one embodiment before and after a crimping operation.

FIG. 1 is a perspective view of a portion of a cable assembly 100 in accordance with one embodiment before a crimping operation (referenced as 102) and after the crimping operation (referenced as 104). The cable assembly 100 includes a crimp contact 105 and an electrical wire 106 having a terminal end 108 that includes at least one exposed wire conductor 110. The electrical wire 106 may be used to transmit electrical power or data signals. The electrical wire 106 may have a jacket 107 that is removed (e.g., stripped) to expose the wire conductors 110. In the illustrated embodiment, the electrical wire 106 includes sixteen wire conductors (or strands) 110, but the electrical wire 106 may have fewer or more wire conductors 110 in other embodiments.

In FIG. 1, the cable assembly 100 is oriented with respect to a central longitudinal axis 190. The longitudinal axis 190 may extend through a geometric center of the cable assembly 100 after formation. The crimp contact 105 is configured to be deformed (e.g., crimped or crushed) during the crimping operation to grip the wire conductors 110 and thereby establish an electrical and mechanical connection between the wire conductors 110 and the crimp contact 105. As shown in FIG. 1, the crimp contact 105 only grips the wire conductors 110 of one electrical wire 106. In alternative embodiments, however, the wire conductors from separate electrical wires may be inserted into a channel of the crimp contact 105 and pressed together (e.g., mechanically and electrically joined) within the channel through the crimping operation.

The crimp contact 105 may be stamped and formed from conductive sheet material (e.g., metal). As described herein, the crimp contact 105 may be dimensioned to grip a plurality of different wire gauges within a designated range. For example, the crimp contact 105 may be dimensioned to grip cables or electrical wires having an American Wire Gauge (AWG) between 10-22 AWG. In particular embodiments, the crimp contact 105 may be dimensioned to surround and grip wire conductors having a total cross-sectional area of X and, separately, to surround and grip wire conductors having a total cross-sectional area of at least about 3X or 5X or, more particularly, at least about 8X. As one non-limiting example, a first type of electrical wire may have wire conductors with a total (e.g., collective) cross-sectional area of about 0.75 $mm^2$ and a second type of electrical wire may have wire conductors with a total cross-sectional area of at least about 5.00 $mm^2$. Embodiments described herein may be configured to grip either of the first and second types. As another non-limiting example, a first type of electrical wire may have wire conductors with a total cross-sectional area of about 1.00 $mm^2$ and a second type of electrical wire may have wire conductors with a total cross-sectional area of at least about 3.00 $mm^2$. In the case of multiple wire conductors, each strand may have, by way of example only, radiuses of about 0.125 mm. However, the wire conductors may have other dimensions in alternative embodiments.

Figure 2:
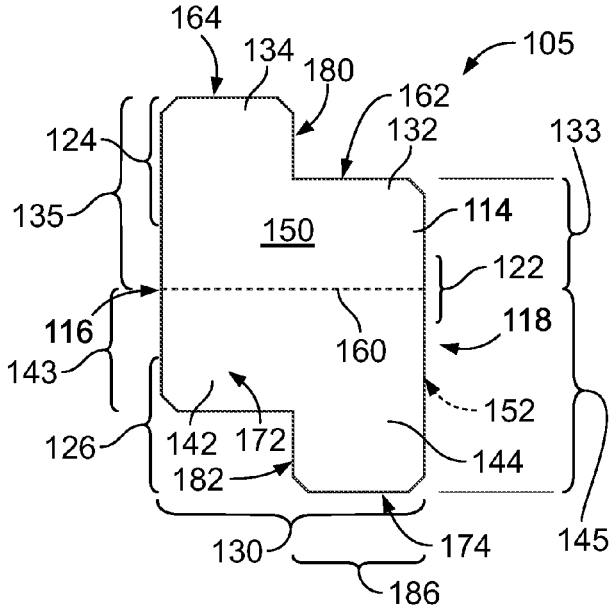
FIG. 2 is a plan view of an unformed crimp contact in accordance with one embodiment that may be used with the cable assembly of FIG. 1.

FIG. 2 is a plan view of the crimp contact 105 after the crimp contact 105 is stamped from sheet material but before being shaped for the crimping operation. With respect to FIGS. 1 and 2, the crimp contact 105 has a contact body 114 that extends longitudinally between a leading edge or end 116 and a trailing edge or end 118. The contact body 114 has a contact length 130 that is measured along the longitudinal axis 190 (FIG. 1). The contact body 114 has an interior surface 150 and an exterior surface 152 that face in opposite directions and define a thickness 154 (FIG. 1) of the contact body 114 therebetween. In an exemplary embodiment, the thickness 154 is substantially uniform throughout, but may vary in other embodiments. The interior surface 150 is configured to directly engage the wire conductors 110. In some embodiments, a portion of the exterior surface 152 may also engage the wire conductors 110 after the crimping operation.

The contact body 114 includes a center portion 122 and opposite first and second sidewalls 124, 126, that are joined by the center portion 122. As shown in FIG. 2, the contact body 114 has a centerline 160 that extends through a middle of the center portion 122. The center portion 122 and the centerline 160 may extend parallel to the longitudinal axis 190 (FIG. 1). As shown in FIGS. 1 and 2, the first and second sidewalls 124, 126 extend in opposite directions away from the center portion 122 (or the centerline 160). As such, the first and second sidewalls 124, 126 may be characterized as extending laterally away from the center portion 122 (or the centerline 160).

The first and second sidewalls 124, 126 are configured to be deformed around and pressed against the wire conductors 110. The first and second sidewalls 124, 126 may have similar structural features. For example, the first sidewall 124 has a base section 132 and a leg section 134, and the second sidewall 126 may also have a base section 142 and a leg section 144. The base and leg sections 132, 134 have longitudinal edges 162, 164, respectively, and the base and leg sections 142, 144 have longitudinal edges 172, 174. The longitudinal edges 162, 164, 172, 174 extend parallel to the longitudinal axis 190 in the illustrated embodiment.

As shown, the leg section 134 and the base section 142 are located along the leading edge 116, and the leg section 144 and the base section 132 are located along the trailing edge 118. The leg section 134 is defined between a portion of the leading edge 116 and an interior edge 180. The leading and interior edges 116, 180 may face in opposite directions along the longitudinal axis 190. The interior edge 180 extends between the longitudinal edges 162, 164. The leg section 144 is defined between a portion of the trailing edge 118 and an interior edge 182. The leading and interior edges 118, 182 may face in opposite directions along the longitudinal axis 190. The interior edge 182 extends between the longitudinal edges 172, 174. As shown, the interior edges 180, 182 extend in directions that are substantially transverse (or perpendicular) to the longitudinal axis 190. The interior edges 180, 182 may also be characterized as extending along planes that are substantially orthogonal to the longitudinal axis 190. As shown in FIGS. 1 and 2, the leg section 134 and the base section 142 may be located opposite each other, and the leg section 144 and the base section 132 may be located opposite each other.

With respect to FIG. 2, the sections of the different sidewalls extend different lateral distances from the center portion 122 or the centerline 160. For example, the leg section 134 extends a lateral distance 135 from the centerline 160 to the longitudinal edge 164 of the leg section 134. The base section 132 extends a lateral distance 133 from the centerline 160 to the longitudinal edge 162 of the base section 132. The lateral distance 135 of the leg section 134 is greater than the lateral distance 133 of the base section 132. Likewise, the leg section 144 extends a lateral distance 145 from the centerline 160 to the longitudinal edge 174 of the leg section 144. The base section 142 extends a lateral distance 143 from the centerline 160 to the longitudinal edge 174 of the base section 142. Accordingly, the contact body 114 may have a staggered geometric configuration in which each of the longer leg sections directly opposes a shorter base section.

In the illustrated embodiment, the lateral distances 135 and 145 are substantially equal and the lateral distances 133 and 143 are substantially equal. In other embodiments, however, the lateral distances 135, 145 may not be equal and/or the lateral distances 133, 143 may not be equal. Also, in the illustrated embodiment, the contact body 114 includes only two leg sections and only two base sections. In other embodiments, there may be more leg sections and/or base sections. For example, a third leg section may extend along the trailing edge 118 such that the base section 132 is located between the third leg section and the leg section 134. A third base section may extend along the trailing edge 118 such that the leg section 144 is located between the third base section and the base section 142. However, the contact body is not required to have opposing leg and base sections throughout. For example, in another alternative embodiment, third and fourth base sections may oppose each other along the trailing edge 118 with the centerline 160 therebetween.

As shown in FIG. 2, the longitudinal edges 162, 164, 172, 174 may define a section width 186. The section width 186 is measured along the longitudinal axis 190. Each of the longitudinal edges 162, 164, 172, 174 may have a substantially equal section width 186 as shown in FIG. 2. However, in other embodiments, the section widths 186 may not be equal.

With respect to FIG. 1, after the crimping operation, the cable assembly 100 may be mechanically and electrically connected to a mating contact 112 during a mating operation (referenced as 109). The mating contact 112 may have a projection 121 that is configured to engage an electrical connector. In the illustrated embodiment, the mating contact 112 defines a contact cavity 115 that is sized and shaped to receive the leading edge 116 of the crimp contact 105. The crimp contact 105 may be advanced in a direction that is parallel to the longitudinal axis 190 and inserted into the contact cavity 115. In other embodiments, the mating contact 112 may be similar to the crimp contact 105 and folded around the crimp contact 105. In yet another alternative embodiment, the crimp contact 105 may be mechanically and electrically coupled to an electrical component by soldering the crimp contact 105 to the other electrical contact.

Figure 3:
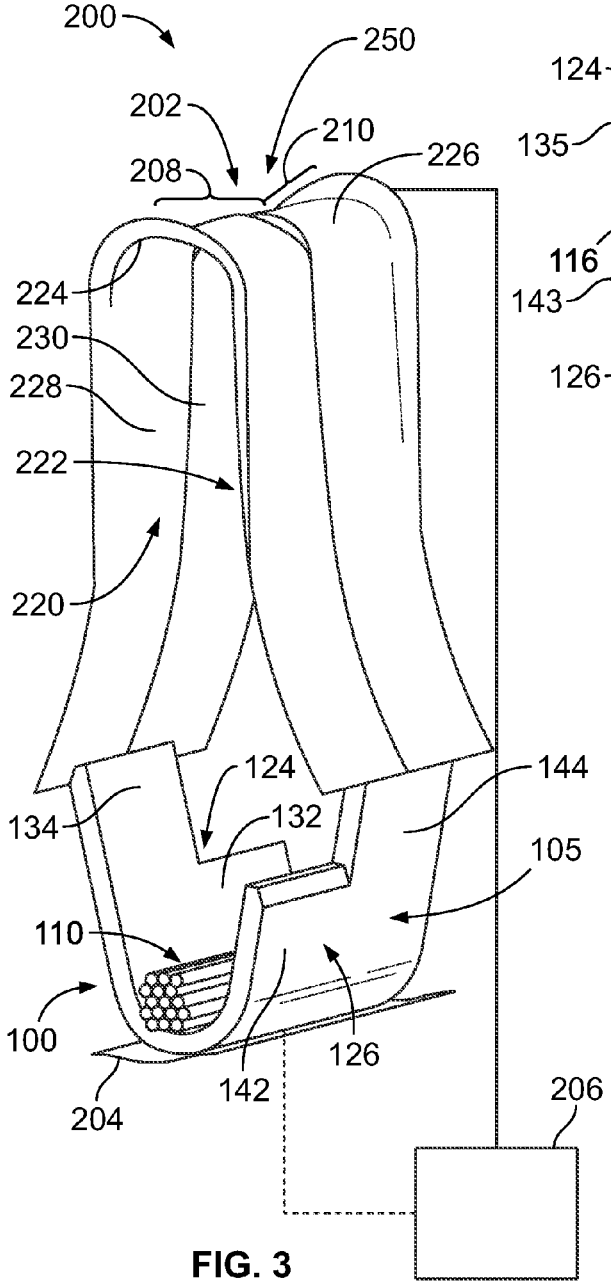
FIG. 3 is a perspective view of a crimping system that is used during the crimping operation to manufacture the cable assembly of FIG. 1.

FIG. 3 is a perspective view of a crimping system 200 that may be used during the crimping operation to manufacture the cable assembly 100. The crimping system 200 includes a crimping applicator 202, a contact support 204 that is configured to hold the crimp contact 105, and an actuator 206, which is schematically represented as a box in FIG. 3. The actuator 206 may be operably coupled to the crimping applicator 202 and/or the contact support 204. The actuator 206 may be, for example, a linear motor that is configured to drive at least one of the crimping applicator 202 or the contact support 204 toward the other with the crimp contact 105 therebetween. In the illustrated embodiment, the crimping applicator 202 is moved in a linear direction by the actuator 206 toward the contact support 204. In alternative embodiments, the contact support 204 may be moved toward the crimping applicator 202, or each of the contact support 204 and the crimping applicator 202 may be moved toward each other. The crimp contact 105 is configured to be deformed by the crimping applicator 202 and the contact support 204 while holding the wire conductors 110.

Figure 4:
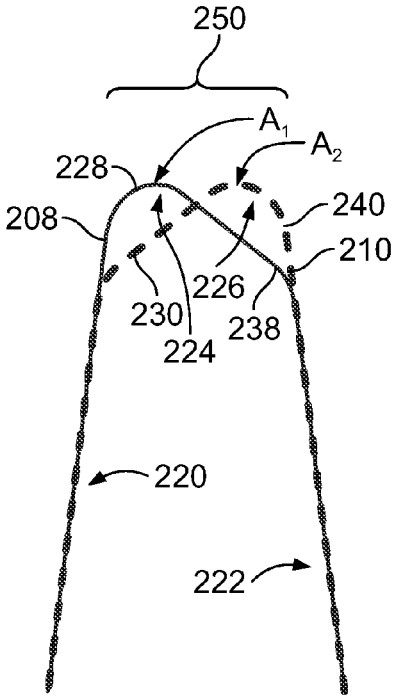
FIG. 4 is a representative end view of a crimping applicator that may be used with the system of FIG. 3.

FIG. 4 is a representative end view of the crimping applicator 202. With respect to FIGS. 3 and 4, the crimping applicator 202 includes leading and trailing portions 208, 210. In FIG. 4, the leading portion 208 is represented as a solid line, and the trailing portion 210 is represented as a dashed line. The leading portion 208 is configured to engage the leg and base sections 134, 142 (FIG. 3), and the trailing portion 210 is configured to engage the leg and base sections 144, 132 (FIG. 3). The leading and trailing portions 208, 210 may be separate parts that are held together during the crimping operation or may be integrally formed.

The crimping applicator 202 defines opposing first and second contoured walls 220, 222. The first contoured wall 220 is configured to initially engage the first sidewall 124 (FIG. 3), and the second contoured wall 222 is configured to initially engage the second sidewall 126 (FIG. 3). The leading and trailing portions 208, 210 include respective wall portions 228, 230 that define the first contoured wall 220 and respective wall portions 238, 240 (FIG. 4) that define the second contoured wall 222.

The leading and trailing portions 208, 210 may have wall-bending features 224, 226, respectively. The wall-bending features 224, 226 are sections of the leading and trailing portions 208, 210, respectively, that have predetermined shapes for forming the crimp contact 105. The wall-bending features 224, 226 are shaped differently than each other. As will be shown and described with reference to FIGS. 5-8, the wall-bending feature 224 is configured to more sharply bend the leg section 134 than the base section 142, and the wall-bending feature 226 is configured to more sharply bend the leg section 144 than the base section 132. As shown in FIG. 4, the wall bending features 224, 226 have respective apexes $A_1$, $A_2$ that are laterally offset from each other. Accordingly, the wall-bending features 224, 226 may form a discontinuous joint 250 of the crimping applicator 202.

Figure 5:
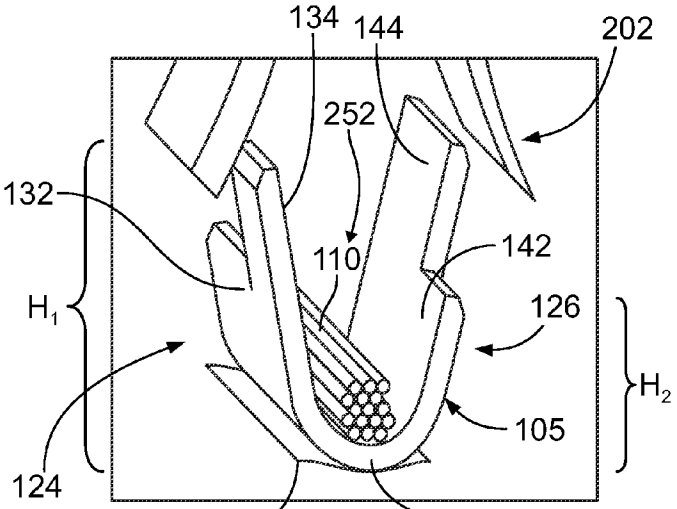
FIG. 5 is a perspective view illustrating the crimping applicator and a crimp contact before a crimping operation.

FIGS. 5-8 illustrate the crimping operation for one embodiment. As shown in FIG. 5, the center portion 122 and the first and second sidewalls 124, 126 of the crimp contact 105 may define a conductor-receiving channel 252 that is configured to receive at least one wire conductor. The conductor-receiving channel 252 may hold numerous wire conductors 110 (e.g., five or more wire conductors). The crimp contact 105 is positioned on the contact support 204 such that the crimp contact 105 is located between the contact support 204 and the crimping applicator 202. As shown, the leg sections 134, 144 may have a height $H_1$ with respect to the contact support 204, and the base sections 132, 142 may have a height $H_2$ with respect to the contact support 204. The first height $H_1$ is greater than the second height $H_2$. In alternative embodiments, the leg sections 134, 144 may extend to different heights. Likewise, the base sections 132, 142 may extend to different heights.

Figure 6:
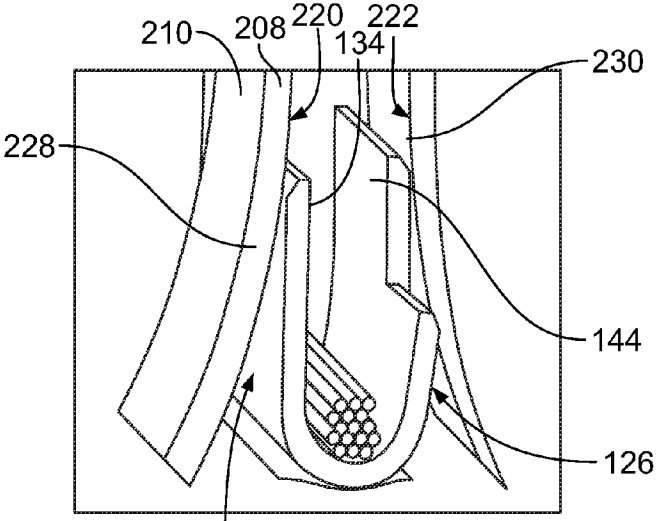
FIG. 6 illustrates a first stage of the crimping operation in which the crimping applicator engages sidewalls of the crimp contact.

As shown in FIG. 6, during a first crimping stage the first and second contoured walls 220 and 222 engage the first and second sidewalls 124, 126 such that the first and second sidewalls 124, 126 are bent toward each other. More specifically, the wall portion 228 of the leading portion 208 may engage the leg section 134, and the wall portion 230 of the trailing portion 210 may engage the leg section 144. In the first crimping stage, the first and second sidewalls 124, 126 may be bent to extend substantially parallel to each other.

Figure 8:
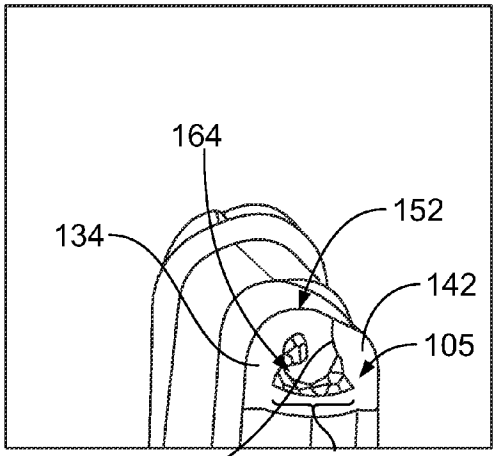
FIG. 8 is a perspective view illustrating the crimping applicator and the crimp contact at an end of the crimping operation.
Figure 7:
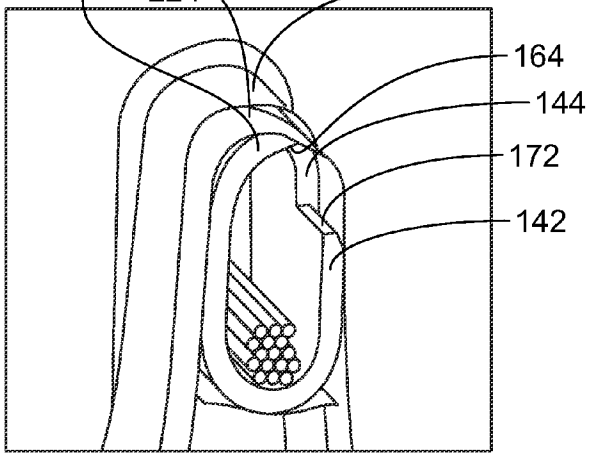
FIG. 7 illustrates a second stage of the crimping operation in which the crimping applicator begins to bend ends of the sidewalls radially inwardly.

FIG. 7 illustrates a second crimping stage. During the second crimping stage, the leg sections 134, 144 engage the wall-bending features 224, 226, respectively, prior to the base sections 132 (FIG. 5), 142 engaging the wall-bending features 226, 224 due to the different heights $H_1$, $H_2$. The wall-bending features 224, 226 have designated contours (e.g., radiuses of curvature) that are configured to bend the leg sections 134, 144 in a predetermined manner. In the illustrated embodiment, the leg section 134 is bent so that the longitudinal edges 164 slides under the longitudinal edge 172. As shown in FIG. 8, the longitudinal edge 164 is located under the longitudinal edge 172 within a contact cavity 254 that is defined by the deformed crimp contact 105. Although not shown, the longitudinal edge 174 of the leg section 144 is located under the longitudinal edge 162 of the base section 132 within the contact cavity 254. As such, portions of the leg sections 144 and 134 may be within the contact cavity 254 after the crimp contact 105 is deformed.

Accordingly, the leg section 134 of the first sidewall 124 may interface with the opposite base section 142 of the second sidewall 126, and the leg section 144 of the second sidewall 126 may interface with the opposite base section 132 of the first sidewall 124. A leg section may interface with a base section when the longitudinal edge of the leg section or the exterior surface of the leg section is located proximate to the longitudinal edge of the opposite base section. For example, as shown in FIG. 8, the exterior surface 152 along the leg section 134 engages the longitudinal edge 172 of the base section 142. In other embodiments, the longitudinal edge 164 may be located proximate to (e.g., engage or be slightly spaced apart) the longitudinal edge 172 of the base section 142.

Figure 11:
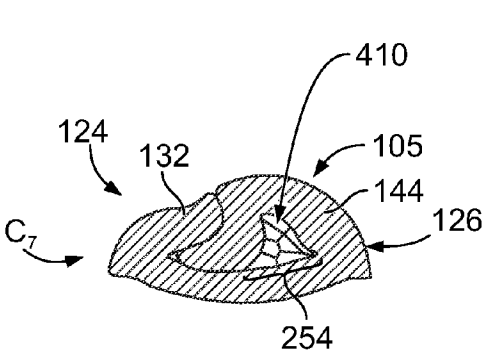
FIG. 11 shows different cross-sections of the crimp contact of FIG. 1 after the crimping operation for a different third wire gauge.
Figure 11:
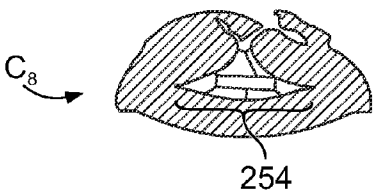
Figure 11:
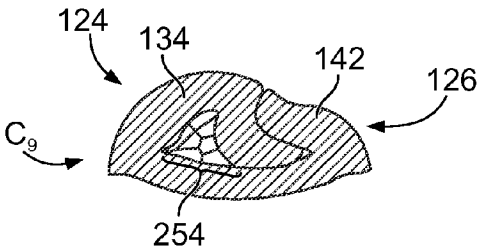
Figure 10:
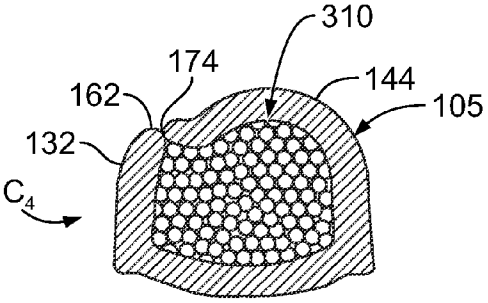
FIG. 10 shows different cross-sections of the crimp contact of FIG. 1 after the crimping operation for a different second wire gauge.
Figure 10:
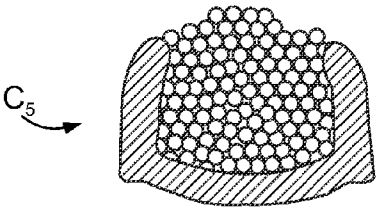
Figure 10:
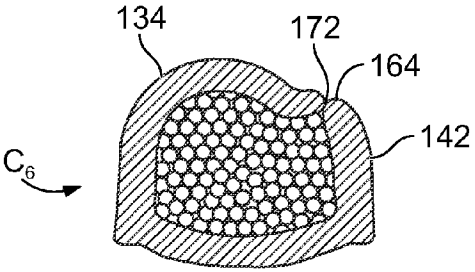
Figure 9:
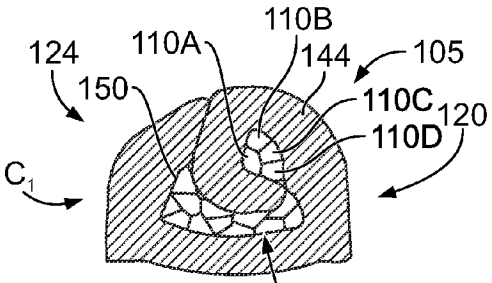
FIG. 9 shows different cross-sections of the crimp contact of FIG. 1 after the crimping operation for a first wire gauge.
Figure 9:
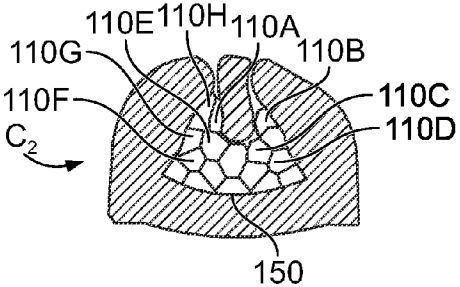
Figure 9:
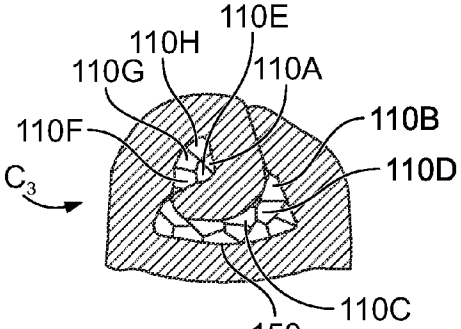

FIGS. 9-11 illustrate cross-sections of the crimp contact 105 for electrical wires with different wire gauges. For example, FIG. 9 illustrates three cross-sections $C_1$, $C_2$, and $C_3$ that are taken at different longitudinal locations along the crimp contact 105. In FIG. 9, the wire gauge of the electrical wire 106 (FIG. 1) is 18 AWG. The longitudinal locations of the cross-sections may be as shown in FIG. 1. More specifically, $C_1$ may extend through the base section 132 and the leg section 144 (or proximate to the trailing edge 118); $C_2$ may extend approximately along an interface 260 between the interior edges 180, 182 (FIG. 2); and $C_3$ may extend through the base section 142 and the leg section 134 (or proximate to the leading edge 116).

In some embodiments, the configurations of the first and second sidewalls 124, 126 cause a varying conductor density or distribution within the contact cavity 254 when the crimp contact 105 is deformed. For instance, by comparing the cross-sections $C_1$, $C_2$, and $C_3$, it is shown that the leg sections 134, 144 may surround different arrangements of the wire conductors 110. A first arrangement of wire conductors is different from a second arrangement if at least one of the wire conductors in the first arrangement is not within the second arrangement or vice versa. For example, as shown in the cross-section $C_1$, the wire conductors 110A, 110B, 110C, and 110D are surrounded by the leg section 144. In the cross-section $C_3$, the wire conductors 110A, 110E, 110F, 110G and 110H are surrounded by the leg section 134. For illustration, the wire conductors 110B, 110C, and 110D are also shown in $C_3$. In the cross-section $C_2$, the wire conductors 110A-110H have different locations with the contact cavity 254 than in the cross-sections $C_1$ and $C_3$. Thus, the leg sections 134, 144 surround different arrangements of the wire conductors 110. In FIG. 9, the leg sections 134, 144 only surround one common wire conductor, which is the wire conductor 110A. In other embodiments, however, the leg sections 134, 144 may surround more than one common conductor.

This varying conductor distribution may cause multiple different contact points where the interior surface 150 of the crimp contact 105 engages the wire conductors 110 thereby increasing the friction between the wire conductors 110 and the interior surface 150. As such, a greater tensile force to remove the wire conductors 110 from the crimp contact 105 may be required. Moreover, the changing orientation or position of individual wire conductors 110 may cause a greater frictional force than other known crimp contacts and, as such, would require a greater tensile force to remove the wire conductors. For example, in an exemplary embodiment, the common wire conductor 110A wraps between the interior edges 180, 182. If the electrical wire 106 was inadvertently pulled away from the crimp contact 105 after the crimp contact 105 was deformed, the configuration of the wire conductor 110A and the interior edge 182 may cause a greater frictional force that would prevent the withdrawal. Accordingly, the crimp contact 105 may provide greater resistance to inadvertent removal of the wire conductors 110 than other known crimp contacts.

In FIG. 10, the wire gauge of the electrical wire (not shown) that includes the wire conductors 310 is 10 AWG. Cross-sections $C_4$, $C_5$, and $C_6$ are shown and may have similar longitudinal locations as the cross-sections $C_1$, $C_2$, and $C_3$, respectively. As shown, a cross-sectional area of the wire conductors 310 is greater than a cross-sectional area of the wire conductors 110 shown in FIG. 9. Due to the cross-sectional area of the wire conductors 310, the leg sections 144, 134 may not be capable of moving under the base sections 132, 142, respectively, during the crimping operation. Instead, the longitudinal edges 164 and 172 may interface with each other, and the longitudinal edges 162 and 174 may interface with each other.

In FIG. 11, the wire gauge of the electrical wire (not shown) that includes the wire conductors 410 is 10 AWG. Cross-sections $C_7$, $C_8$, and $C_9$ are shown and may have similar longitudinal locations as the cross-sections $C_1$, $C_2$, and $C_3$, respectively. As shown, a cross-sectional area of the wire conductors 410 is less than the cross-sectional area of the wire conductors 110 (FIG. 9) and less than the cross-sectional area of the wire conductors 310. During the crimping operation, the crimp contact 105 may be deformed in a similar manner as the embodiment that includes the wire conductors 110. For example, the leg section 144 may slide under the base section 132 as shown in the cross-section $C_7$, and the leg section 134 may slide under the base section 142 as shown in the cross-section $C_9$. Accordingly, portions of the leg sections 144 and 134 may be within the contact cavity 254 after the crimp contact 105 is deformed. In the embodiment of FIG. 11, all of the wire conductors 410 are surrounded by the leg section 144 and all of the wire conductors 410 are surrounded by the leg section 134.

In FIG. 11, the conductor distribution within the contact cavity 254 shows an even greater lateral shifting of the wire conductors 410 than the lateral shifting of the wire conductors 110 in FIG. 9. By comparing the cross-sections $C_7$, $C_8$, and $C_9$, it is shown that the wire conductors 410 are immediately surrounded by the first sidewall 124 for a first portion of the contact length 130 (FIG. 1) and immediately surrounded by the second sidewall 126 for a second portion of the contact length 130.

Figure 12:
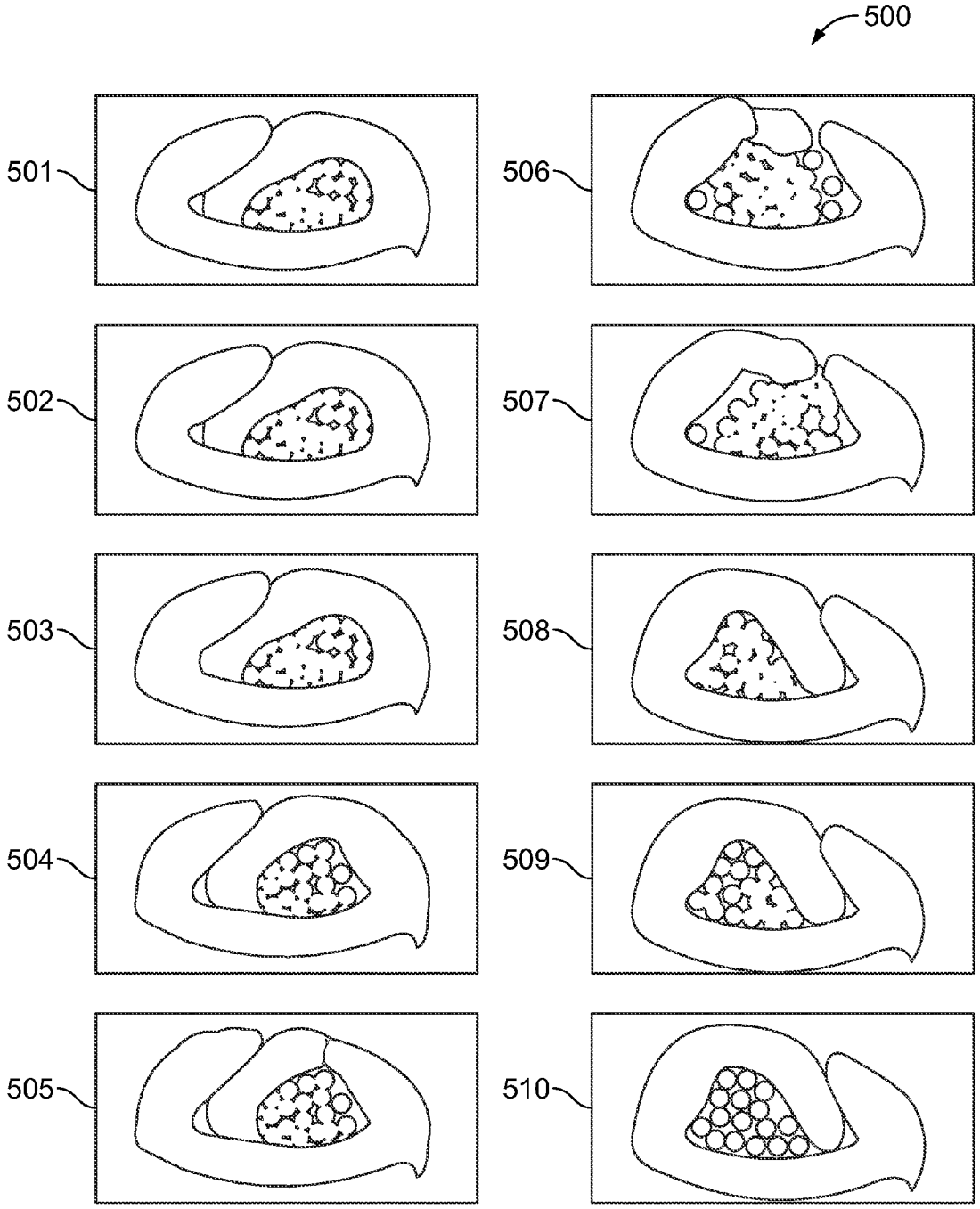
FIG. 12 shows several cross-sectional images of a cable assembly formed in accordance with one embodiment.

FIG. 12 shows a series of cross-sectional images 501-510 of a cable assembly 500 formed in accordance with one embodiment. The wire gauge of the electrical wire in FIG. 12 is 18 AWG. The cross-sectional images 501-510 of the cable assembly 500 were captured along a series of longitudinal locations (in the order as shown in FIG. 12). The image 501 is proximate to the trailing edge, and the image 510 is proximate to the leading edge. In other embodiments, however, the image 501 may be proximate to the leading edge and the image 510 may be proximate to the trailing edge. The images 505-507 are proximate to the interface between interior edges as described above. As shown, the crimp contact may securely grip the wire conductors within the contact cavity as described in other embodiments.

Accordingly, the crimp contacts described herein may be configured to grip the wire conductors of electrical wires having a greater range of wire gauges than known crimp contacts. In addition, the crimp contacts may enable a greater gripping or compressive force caused by an increase in friction between the interior surface of the crimp contact and the wire conductors within the contact cavity of the crimp contact. In order to remove the wire conductors, a greater withdrawal force may be required to overcome the gripping force.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable assembly comprising:

an electrical wire having a jacket and multiple wire conductors surrounded by the jacket, the jacket being removed from the electrical wire at a terminal end of the electrical wire to expose the wire conductors; and a crimp contact having opposite interior and exterior surfaces, the crimp contact having a centerline and first and second sidewalls that extend from the centerline in opposite directions, the centerline extending parallel to a longitudinal axis of the crimp contact, each of the first and second sidewalls having a base section and a leg section, the leg section extending a lateral distance from the centerline to a longitudinal edge of the leg section, the base section extending a lateral distance from the centerline to a longitudinal edge of the base section, the longitudinal edges extending between the interior and exterior surfaces, the lateral distance of the leg section being greater than the lateral distance of the base section for each of the first and second sidewalls, the leg section of the first sidewall being located opposite the base section of the second sidewall, the leg section of the second sidewall being located opposite the base section of the first sidewall;

wherein the crimp contact is crimped such that the interior surface surrounds and compresses the wire conductors within a contact cavity, the crimp contact being crimped such that the exterior surface along at least one of the leg sections engages the longitudinal edge of the opposing base section and the longitudinal edge of the at least one leg section is at least one of in the contact cavity or under the opposing base section.

2. The cable assembly of claim 1, wherein the at least one leg section extends under the opposing base section, the exterior surface along the at least one leg section intimately engaging the interior surface along the opposing base section.

3. The cable assembly of claim 1, further comprising a mating contact, the crimp contact extending longitudinally between leading and trailing edges in which the trailing edge faces an edge of the jacket of the electrical wire, the mating contact being mechanically and electrically coupled to the crimp contact at the leading edge of the crimp contact.

4. The cable assembly of claim 1, wherein the crimp contact has a contact length that extends along the longitudinal axis, the wire conductors being immediately surrounded by the leg section of the first sidewall for a first portion of the contact length and immediately surrounded by the leg section of the second sidewall for a second portion of the contact length.

5. The cable assembly of claim 1, wherein the leg sections of the first and second sidewalls have interior edges that interface with each other, the exterior surface along each of the leg sections engaging the longitudinal edge of the opposing base section.

6. The cable assembly of claim 1, each of the leg sections of the first and second sidewalls surrounds a respective group of the wire conductors.

7. The cable assembly of claim 1, wherein the wire conductors include numerous wire conductors, each of the leg sections of the first and second sidewalls surrounding at least one common wire conductor of the numerous wire conductors.

8. The cable assembly of claim 7, wherein the crimp contact extends along the longitudinal axis between a leading end and a trailing end, the leg section of the first sidewall being located between the leading end of the crimp contact and the leg section of the second sidewall, each of the leg sections of the first and second sidewalls surrounding different first and second arrangements of the wire conductors such that leg section of the first sidewall surrounds at least one corresponding wire conductor that is not surrounded by the leg section of the second sidewall.

9. A crimp contact comprising:

a contact body having opposite interior and exterior surfaces, the contact body having a centerline and first and second sidewalls that extend from the centerline in opposite directions, the centerline extending parallel to a longitudinal axis of the crimp contact, each of the first and second sidewalls having a base section and a leg section, the leg section extending a lateral distance from the centerline to a longitudinal edge of the leg section, the base section extending a lateral distance from the centerline to a longitudinal edge of the base section, the longitudinal edges extending between the interior and exterior surfaces, the lateral distance of the leg section being greater than the lateral distance of the base section for each of the first and second sidewalls, the leg section of the first sidewall being located opposite the base section of the second sidewall, the leg section of the second sidewall being located opposite the base section of the first sidewalk;

wherein the contact body is configured to surround and compress multiple wire conductors within a contact cavity during a crimping operation, the contact body being dimensioned such that the exterior surface along at least one of the leg sections engages the longitudinal edge of the opposing base section and the longitudinal edge of the at least one leg section is at least one of in the contact cavity or under the opposing base section.

10. The crimp contact of claim 9, wherein the wire conductors have a collective cross-sectional area, the crimp contact being dimensioned to be crimped around a designated range of collective cross-sectional areas, the designated range including a collective cross-sectional area that is between X and 8X.

11. The crimp contact of claim 9, wherein the wire conductors have a collective cross-sectional area, the crimp contact being dimensioned to be crimped around a designated range of collective cross-sectional areas, the designated range including a collective cross-sectional area that is between 0.75 $mm^2$ and 5.00 $mm^2$.

12. The crimp contact of claim 9, wherein the at least one leg section is configured to extend under the opposing base section such that the exterior surface along the at least one leg section intimately engages the interior surface along the opposing base section.

13. The cable assembly of claim 1, wherein the crimp contact extends longitudinally between leading and trailing edges, the trailing edge facing an edge of the jacket of the electrical wire.

14. A cable assembly comprising:

an electrical wire having a jacket and at least one wire conductor surrounded by the jacket, the jacket being removed from the electrical wire at a terminal end of the electrical wire to expose the at least one wire conductor; and a crimp contact having opposite interior and exterior surfaces, the crimp contact having a centerline and first and second sidewalls that extend from the centerline in opposite directions, the centerline extending parallel to a longitudinal axis of the crimp contact, each of the first and second sidewalls having a base section and a leg section, the leg section extending a lateral distance from the centerline to a longitudinal edge of the leg section, the base section extending a lateral distance from the centerline to a longitudinal edge of the base section, the longitudinal edges extending between the interior and exterior surfaces, the lateral distance of the leg section being greater than the lateral distance of the base section for each of the first and second sidewalls, the leg section of the first sidewall being located opposite the base section of the second sidewall, the leg section of the second sidewall being located opposite the base section of the first sidewall, wherein the leg sections of the first and second sidewalls surround and directly engage the exposed at least one wire conductor, wherein the at least one wire conductor includes numerous wire conductors and each of the leg sections surrounds some of the wire conductors and does not surround other wire conductors, the leg section of the first sidewall surrounding a majority of the wire conductors and the leg section of the second sidewall surrounding a majority of the wire conductors;

wherein the crimp contact is crimped such that the interior surface surrounds and compresses the wire conductors within a contact cavity, the crimp contact being crimped such that the exterior surface along at least one of the leg sections engages the longitudinal edge of the opposing base section and the longitudinal edge of the at least one leg section is at least one of in the contact cavity or under the opposing base section.

15. The cable assembly of claim 1, wherein the leg section of at least one of the first or second sidewalls extends under the opposing base section and penetrates the group of wire conductors such that a plurality of the wire conductors engage the interior surface along the leg section and at least one of the wire conductors engages the exterior surface along the leg section.

16. The cable assembly of claim 1, wherein the exterior surface along the leg section of the first sidewall engages the longitudinal edge of the base section of the second sidewall, wherein the exterior surface along the leg section of the second sidewall engages the longitudinal edge of the base section of the first sidewall.

17. The cable assembly of claim 16, wherein each of the leg sections extends under the opposing base section and the exterior surface of each of the leg sections directly faces and intimately engages the interior surface of the opposing base section.

18. The cable assembly claim 1, wherein the opposing base section is deformed around the at least one leg section such that the interior surface along the base section intimately engages the exterior surface along the at least one leg section and the interior surface along the at least one leg section.

19. The crimp contact of claim 9, wherein the contact body is dimensioned such that:

(a) the interior surface along the opposing base section is configured to intimately engage the exterior surface along the at least one leg section and the interior surface along the at least one leg section when the wire conductors have a first collective cross-sectional area; and (b) the interior surface along the opposing base section is configured to intimately engage the exterior surface along the at least one leg section and configured to not intimately engage the interior surface along the at least one leg section when the wire conductors have a second collective cross-sectional area, the second collective cross-sectional area being greater than the first collective cross-sectional area.

* * * * *